US012117261B2

(12) United States Patent
Davidson

(10) Patent No.: US 12,117,261 B2
(45) Date of Patent: Oct. 15, 2024

(54) ARCHERY VANE ANGLE TOOL

(71) Applicant: Kyle Davidson, Noblesville, IN (US)

(72) Inventor: Kyle Davidson, Noblesville, IN (US)

( * ) Notice: Subject to any disclaimer, the term of this patent is extended or adjusted under 35 U.S.C. 154(b) by 51 days.

(21) Appl. No.: 17/750,373

(22) Filed: May 22, 2022

(65) Prior Publication Data

US 2022/0373291 A1 Nov. 24, 2022

Related U.S. Application Data

(60) Provisional application No. 63/192,048, filed on May 23, 2021.

(51) Int. Cl.
*F41B 5/14* (2006.01)
*F42B 6/06* (2006.01)

(52) U.S. Cl.
CPC ..... *F41B 5/1446* (2013.01); *F42B 6/06* (2013.01)

(58) Field of Classification Search
CPC ..... F41B 5/1446; F41B 5/148
USPC ..... 283/115, 117
See application file for complete search history.

(56) References Cited

U.S. PATENT DOCUMENTS

| | | | | |
|---|---|---|---|---|
| 2,337,080 A | | 12/1943 | Bitzenburger | |
| 3,192,638 A | * | 7/1965 | Martin | F41B 5/1446 33/506 |
| 3,330,551 A | * | 7/1967 | Bitzenburger | F41B 5/1446 269/254 R |
| 4,653,738 A | * | 3/1987 | York | B25B 1/20 269/38 |
| 8,517,362 B1 | * | 8/2013 | Pittman | F41B 5/1446 269/236 |

* cited by examiner

*Primary Examiner* — John A Ricci

(57) ABSTRACT

An aerodynamic element (often referred to as a vane or fletching) that is operatively coupled to the nock end (the back) of an arrow or similar projectile at an angle to the axis of the projectile is known to stabilize flight. This angle, known as offset or helical, in combination with the airflow generates both low and high pressures on different sides of the vane. This pressure difference imparts a torque around the projectiles primary axis which is one component to stabilizing the arrow's flight. Knowing the exact angle of this offset or helical of the vane to the axis of the arrow is critical to create an arrow with optimal performance. The illustrative tool allows the user to very accurately and precisely adjust a fletching jig to exactly the desired angle, as well as being able to setup multiple jigs with exactly the same setup.

15 Claims, 3 Drawing Sheets

ARCHERY VANE ANGLE TOOL

CROSS-REFERENCE TO RELATED APPLICATION

The present application claims priority to U.S. Provisional Patent Application Ser. No. 63/192,048, filed May 23, 2021, the disclosure of which is expressly incorporated herein by reference.

BACKGROUND AND SUMMARY OF THE DISCLOSURE

The present application relates to archery and, more particularly to a tool that helps with alignment and angle of a vane on an arrow shaft.

Arrows used for the sport of archery has evolved over the thousands of years archery has existed. In recent years, bows as well as arrow shafts have significantly improved in technology and construction methods leading to more consistent products. Now more focus is being given to the individual components and construction of complete arrow assemblies. These arrow assemblies illustratively include a point, an insert, an arrow shaft, vanes and a nock. Vanes, in particular, are aerodynamic elements operatively coupled in some way to the nock end (rear) of the arrow shaft in some sort of polarity arrangement. Simply put, vanes are used to increase the stability of an arrow in flight.

A known issue is that fixtures or jigs most commonly used in the assembly of arrows today do not show accurately what angle the vane is being attached to the shaft of the arrow. This inaccuracy often leads to too much or not enough offset of the vane and therefor poor performance. Too little offset can impart too little spin to the arrow, leading to larger groupings of arrows. Conversely, too much offset can impart too much spin to the arrow resulting in the arrow having excessive drag and losing energy too quickly during flight. Another issue is inconsistency between multiple jigs set-up to fletch arrows. Differences in offset within a set of arrows can also cause inconsistencies with the flight of the arrow.

The archery vane angle or alignment tool (VAT) described in the illustrative embodiment of the present disclosure includes an arrow wrap that is operatively coupled to an arrow shaft, part of an arrow shaft or an object that may be used to represent an arrow shaft. The wrap can be, for example, either a decal, a tube or other graphical representation that has alignment lines originating from a point on the wrap approximately 1 inch from the rear end. Illustratively, these alignment lines extend from that origin point at an angle to a reference line that is parallel to the longitudinal axis of the arrow. These alignment lines can be angled from 0 degrees to 6 degrees between adjacent alignment lines as shown in this illustrative embodiment. The alignment lines may include illustrations and be of any number or angle increments.

A nock can be operatively coupled to the rear end of the arrow shaft which can be used to orient the shaft to a fletching jig. A nock may not be included when not required for positioning the arrow shaft in a fletching jig. A vane may be supported in a clamp or other holding device. The edge of the vane is then aligned to the center point on the wrap where all of the alignment lines originate. The angular adjustability of the jig is then used to adjust the vane to the desired offset or helical by aligning the edge of the vane to the desired alignment line on the vane angle tool. The adjustments on the jig are then secured in place, locking the offset angle of the jig. The vane angle tool is then removed from the fletching jig.

Additional features and advantages of the present invention will become apparent to those skilled in the art upon consideration of the following detailed description of illustrative embodiments exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1:
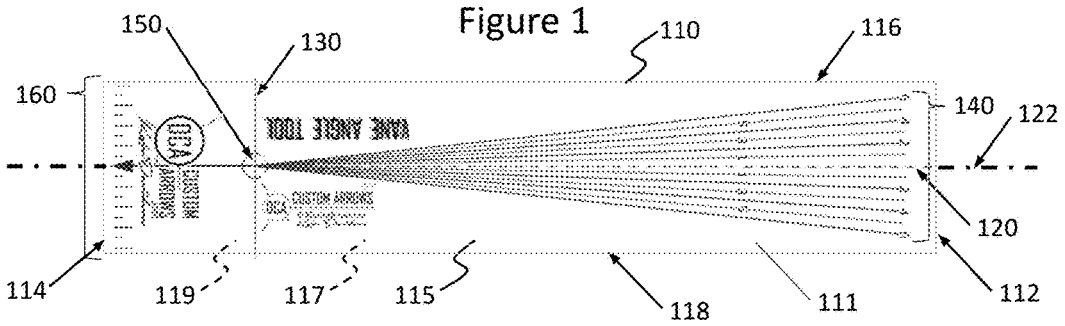
FIG. 1 is a top plan view of an illustrated arrow wrap of the present disclosure, shown in a flat or planar configuration.

For the purposes of promoting an understanding of the principles of the present disclosure, reference will now be made to the embodiments illustrated in the drawings, which are described herein. The embodiments disclosed herein are not intended to be exhaustive or to limit the invention to the precise form disclosed. Rather, the embodiments are chosen and described so that others skilled in the art may utilize their teachings. Therefore, no limitation of the scope of the claimed invention is thereby intended. The present invention includes any alterations and further modifications of the illustrated devices and described methods and further applications of principles in the invention which would normally occur to one skilled in the art to which the invention relates.

FIG. 1 shows an illustrative arrow wrap or decal (110) including a substrate (111) in a flat or planar configuration. In other words, the substrate (111) is not applied to a support, such as a projectile or arrow shaft. The illustrative arrow wrap (110) extends between a front end (112) and a rear end (114), and between a first side (116) and an opposing second side (118). A front surface (115) of the substrate (111) illustratively supports graphical representations, including geometric shapes (e.g., lines) and/or indicia. A rear surface (117) of the substrate (111) illustratively supports an adhesive (119).

The front surface (115) of the substrate (111) illustratively supports a 0-degree or reference line (120) aligned with a longitudinal axis (122) of the wrap (110), a vertical base line (130), angular segments or alignment lines (140), a center or origin point (150) and indexing marks (160). The angular segments or alignment lines (140) are illustratively angled between 0 degrees and 6 degrees relative to each other as measured from the origin point (150). The origin point (150) is defined by the intersection of the reference line (120) and the base line (130).

Figure 2A:
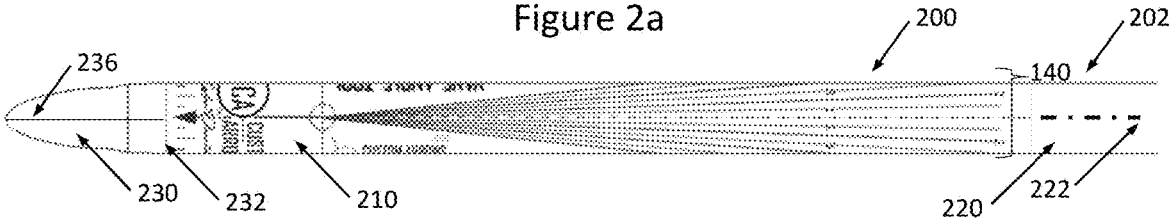
FIG. 2*a* is a top plan view of an illustrative vane angle tool or assembly, showing the arrow wrap of FIG. 1 in an operative or cylindrical configuration applied to an arrow shaft.

FIG. 2*a* is a top plan view of an illustrative vane angle tool (VAT) or assembly (200) including the arrow wrap or decal (110) in cylindrical configuration applied to a cylindrical support, such as a projectile. While the illustrative embodiment is shown as a wrap or decal fixed to a cylindrical support, alternative embodiments may be applied directly onto the cylindrical support through printing or other such means. The cylindrical support illustratively includes an arrow (202) having an arrow shaft (220). It should be appreciated that the arrow (202) and arrow shaft (220) may be representations of an actual arrow shaft, other embodiments may include other cylindrical supports simulating an arrow shaft.

The arrow shaft (220) is shown as extending along a longitudinal axis (222) and including a nock (230) on a rear end (232) thereof. In other illustrative embodiments the nock (230) could be eliminated or integrated into shaft (220). The angular segments or alignment lines (140) are shown relative to the longitudinal axis (222) of the arrow shaft (220). The nock (230) is coupled to the rear end (232) of the arrow shaft (220), and illustratively includes a recess or notch (234) and a visual indicator such as a mold parting line or seam (236).

Figure 2B:
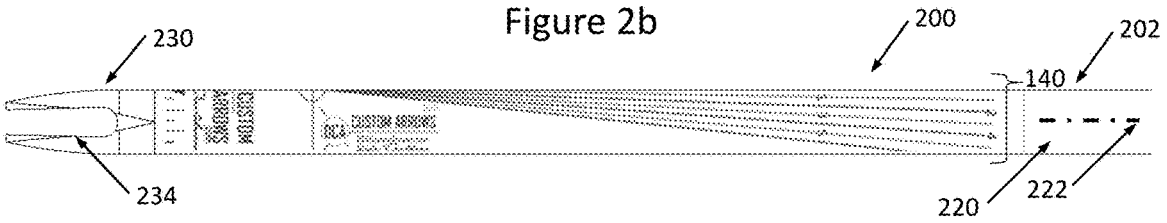
FIG. 2*b* is a side elevational view of the illustrative van angle tool or assembly of FIG. 2*a;*

FIG. 2*b* is a side elevational view of the illustrative vane angle tool (VAT)(200) of FIG. 2*a* including an arrow wrap or decal (110), showing alignment lines (140) relative to the longitudinal axis (222) of the arrow (202) as well as being operatively coupled to the arrow shaft (220) or other representation of the arrow shaft (220) and the nock (230).

Figure 3:
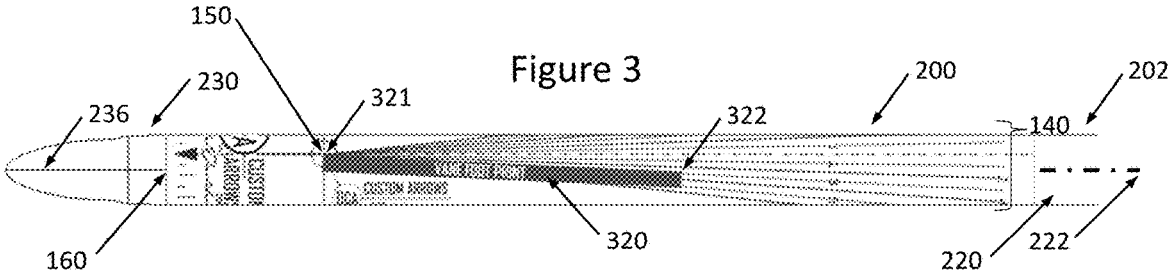
FIG. 3 is a top plan view similar to FIG. 2*a*, showing the nock being indexed and a representative illustration of the foot print of a vane.

FIG. 3 is a top plan view similar to FIG. 2*a* with the nock (230) being indexed in relation to the indexing marks (160) to allow for a vane to be repeatably positioned in the same location. This figure also shows a representative footprint (320) of a vane as it would be aligned on the wrap in a 2.5 degree offset (320). More particularly, a rear left corner (321) of the footprint (320) is located at origin point (150) and a front left corner (322) of the footprint (320) is shown between alignment lines (140) angled between 2 and 3 degrees, resulting in an effective offset of about 2.5 degrees.

Figure 4A:
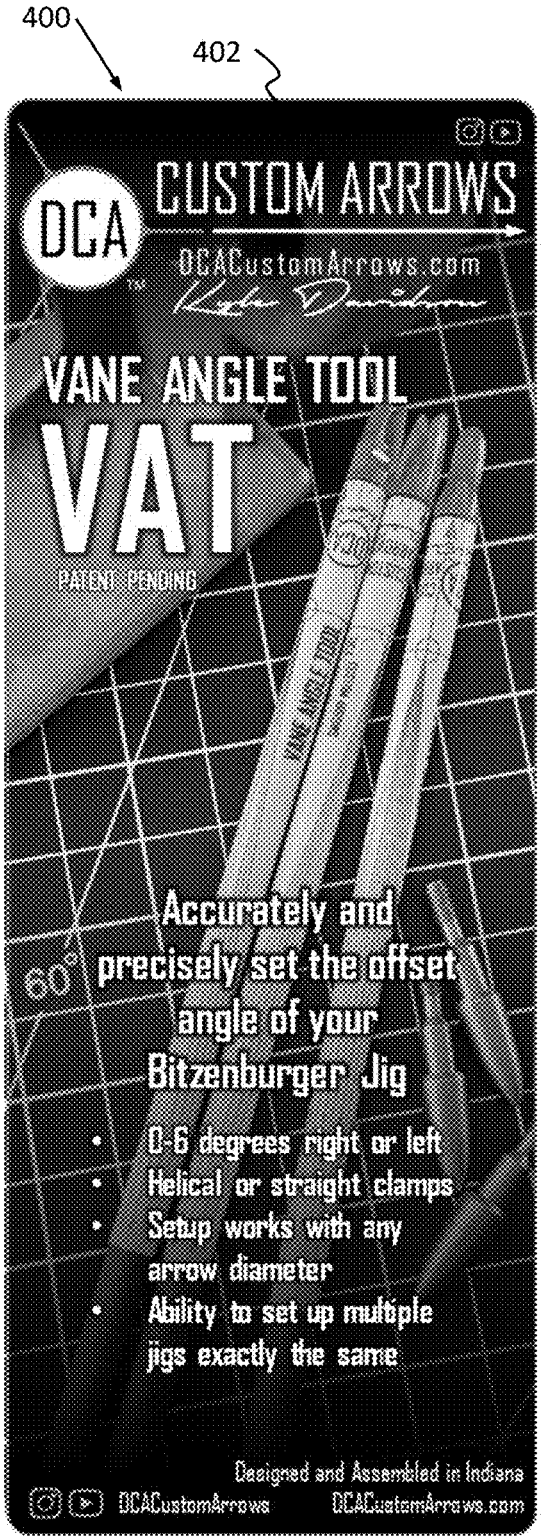
FIG. 4*a* is a front plan view of illustrative packaging for the arrow wrap of FIG. 1.
Figure 4B:
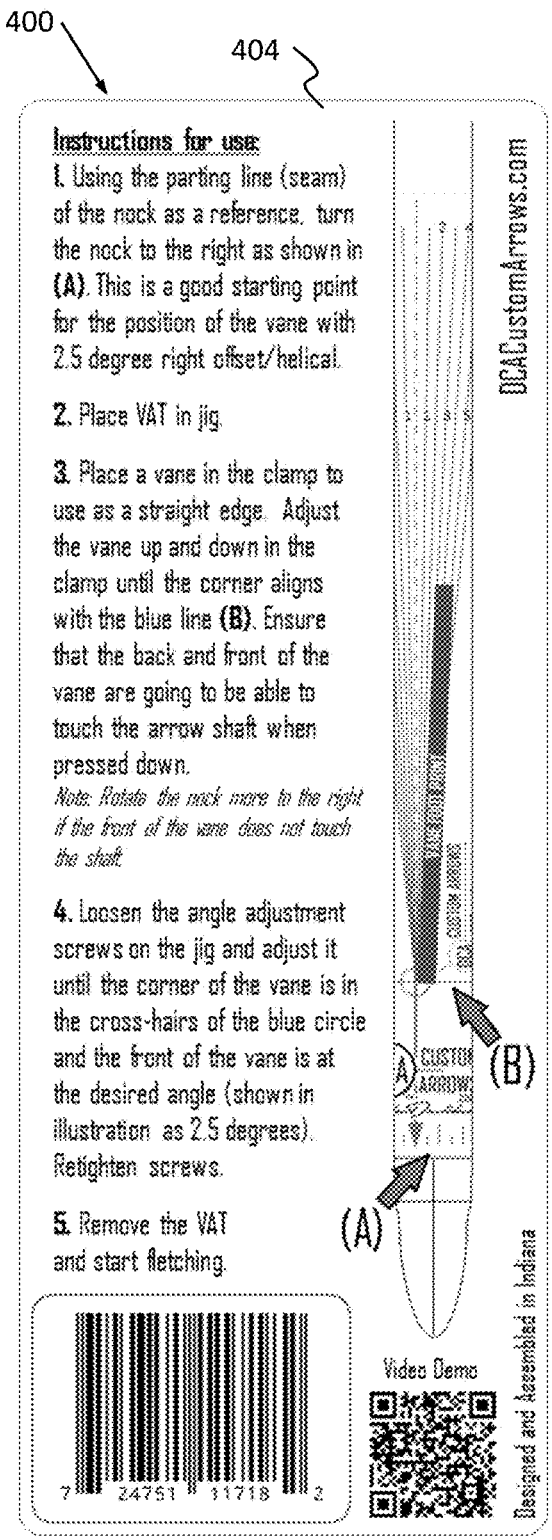
FIG. 4*b* is a rear plan view of the illustrative packaging of FIG. 4*a;*

FIGS. 4*a* and 4*b* show illustrative packaging (400) for the illustrative arrow wrap or decal (110). The front surface (402) of the packaging (400) is shown in FIG. 4*a*, while the rear surface (404) of the packaging (400) is shown in FIG. 4*b*. The rear surface (404) details an illustrative method of using the arrow wrap (110).

Figure 5A:
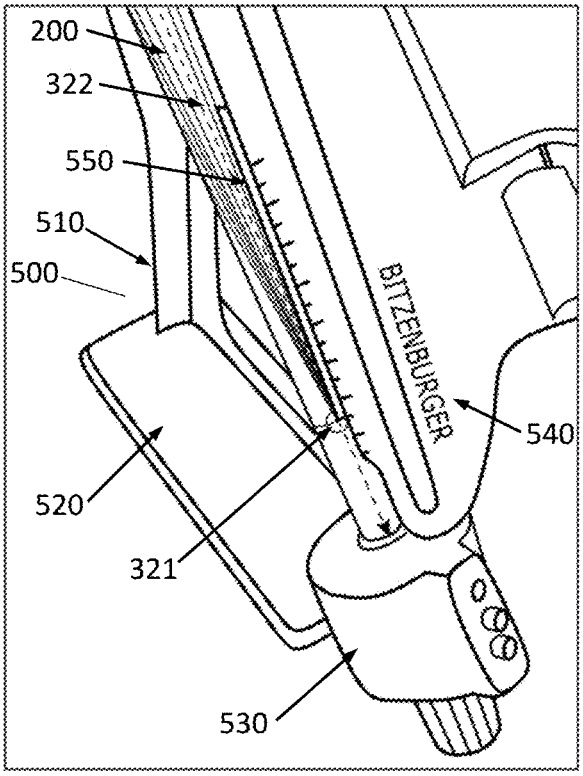
FIG. 5*a* is a first perspective view of a representative fletching jig demonstrating use with the vane angle tool of FIG. 3, with a 2.5 degree offset.
Figure 5B:
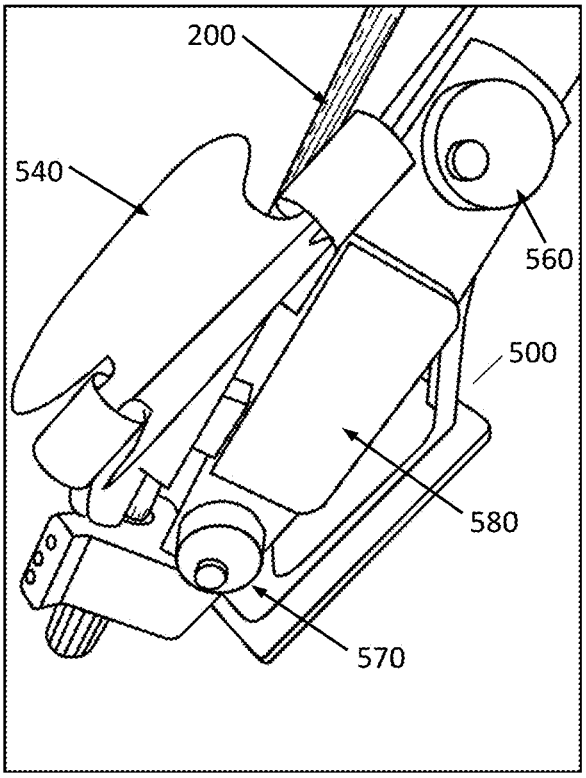
FIG. 5*b* is a second perspective view of a representative fletching jig demonstrating use with the vane angle tool of FIG. 3, illustrating adjustment screws.

FIGS. 5*a* and 5*b* show an illustrative fletching jig (500) for receiving the vane angle tool or assembly (200). The fletching jig (500) illustratively includes support arms (510) extending upwardly from a base (520) and operably coupled to a receiver (530). A clamp (540) holding a vane (550) within the fletching jig (500).

FIG. 5*a* shows the illustrative embodiment vane angle tool or assembly (200) in fletching jig (500). An illustrative fletching jig (500) may be a Bitzenburger fletching jig of the type detailed in U.S. Pat. No. 2,337,080, the disclosure of which is expressly incorporated herein by reference. The fletching jig (500) is shown with a 2.5 degree offset demonstrating use as detailed above.

FIG. 5*b* shows the illustrative embodiment vane angle tool (VAT) (200) in a representative fletching jig (500), illustrating an upper adjustment screw (560) and a lower adjustment screw (570) (note no angle measurement is available with this fletching jig). The adjustment screws (560) and (570) are used to adjust the support structure (580) for the clamp (540). Thereby allowing for the adjustment of the position of the vane, but no indication of the angle.

The illustrative method of using the vane angle tool (VAT)(200) includes the initial steps of using the parting line (seam) (236) of the nock (230) as a reference, rotating the nock (23) about the longitudinal axis (222). In the illustrative embodiment FIG. 3, this step includes turning the nock (230) to the right (clockwise) as view from the nock end. This is a good starting point for the position of the vane with 2.5 degree right offset/helical.

The illustrative method continues by placing the vane angle tool (VAT)(200) in the fletching jig (500). Next, with upper adjustment screw (560) and lower adjustment screw (570) loose or untightened, a user places a vane (550) in the clamp (540) to use as a straight edge, and adjusts the vane (550) and clamp (540) up and down in the clamp (540) until the corner (321) of the vane (550) aligns with the base line (130) and continuing to origin point (150).

The user then ensures that the back and front of the vane (550) are going to be capable to touch the arrow shaft (220) when pressed down during the assembly process. The user should rotate the nock (230) more about the longitudinal axis (222) if the front of the vane (550) does not touch the arrow shaft (220). In this illustrative embodiment this would be rotating the nock (230) more to the left (i.e., counter-clockwise about the longitudinal axis (222) as viewed from the nock (230) end). Once the front corner (322) of the vane (550) is in the desired location/angle (illustratively as 2.5 degrees), The user then retightens screw (560) and (570). The user then removes the vane angle tool (VAT) (200) after having established the desired angle with the vane angle tool (200). Next the user inserts an arrow shaft to start the conventional fletching process with the jig.

Although the invention has been described in detail with reference to certain preferred embodiments, variations and modifications exist within the spirit and scope of the invention as described and defined in the following claims.

What is claimed is:

1. An arrow wrap graphically showing offset angles configured to be used on an arrow shaft or simulated arrow shaft, the arrow wrap comprising:

a substrate extending along a longitudinal axis between a front end and a rear end;

a line segment supported on the substrate that defines a 0 degree line extending co-axial to the longitudinal axis of the substrate and parallel to a longitudinal axis of an arrow shaft;

a base line that is perpendicular to the 0 degree line and the longitudinal axis that intersects the 0 degree line at an origin point a predetermined distance from the rear end of the substrate;

a plurality of alignment lines spaced apart from each other in a plurality of predetermined angles in at least one left offset and right offset, or helical fletching directions that originate at the origin point; and indexing marks oriented around the rear end of the substrate.

2. The arrow wrap of claim 1, wherein the predetermined distance is approximately 1 inch.

3. The arrow wrap of claim 1, wherein the predetermined angles are in a range between 0 degrees and 6 degrees.

4. The arrow wrap of claim 1, further comprising an adhesive applied to a rear surface of the substrate.

5. The arrow wrap of claim 1, further comprising a cylindrical support, the substrate coupled to the cylindrical support positioned within a fletching jig.

6. The arrow wrap of claim 5, further comprising an adhesive applied to a rear surface of the substrate.

7. A vane angle tool for use with an arrow, the vane angle tool comprising:

A cylindrical support;

a substrate in a cylindrical configuration supported on the cylindrical support, the substrate extending along a longitudinal axis between a front end and a rear end;

a line segment supported on the substrate that defines a 0 degree line extending co-axial to the longitudinal axis of the substrate and parallel to a longitudinal axis of the cylindrical support;

a base line that is perpendicular to the 0 degree line and the longitudinal axis that intersects the 0 degree line at an origin point a predetermined distance from the rear end of the substrate;

a plurality of alignment lines spaced apart from each other in a plurality of predetermined angles in at least one left offset and right offset, or helical fletching directions that originate at the origin point; and indexing marks oriented around the rear end of the substrate.

8. The vane angle tool of claim 7, wherein the cylindrical support comprises a simulated arrow shaft.

9. The vane angle tool of claim 7, further comprising a nock operatively coupled to a rear end of an arrow shaft used to orient the arrow to a fletching jig.

10. The arrow wrap of claim 7, wherein the predetermined distance is approximately 1 inch.

11. The arrow wrap of claim 7, wherein the predetermined angles are in a range between 0 degrees and 6 degrees.

12. A method of aligning a vane on an arrow shaft, the method comprising the steps of:

providing a simulated arrow shaft and a nock;

referencing a parting line of the nock;

rotating the nock clockwise about a longitudinal axis of the simulated arrow shaft;

providing a vane angle tool;

providing a jig including a clamp;

placing the vane angle tool within the jig;

placing a vane in the clamp to use as a straight edge;

adjusting the vane up and down in the clamp until a corner aligns with a base line of the vane angle tool;

ensuring that a back and a front of the vane are be able to touch the simulated arrow shaft when pressed down;

rotating the nock clockwise about the longitudinal axis of the simulated arrow shaft if the front of the vane does not touch the simulated arrow shaft;

loosening angle adjustment screws on the jig and adjust the jig until a corner of the vane is proximate to an origin point of the vane angle tool, and the front of the vane is at a desired angle;

retightening the angle adjustment screws on the jig; and removing the vane angle tool.

13. The method of claim 12, further comprising the step of fletching.

14. The method of claim 12, wherein the vane angle tool comprise an arrow wrap including:

a substrate in a cylindrical configuration supported on the simulated arrow shaft, the substrate extending along a longitudinal axis between a front end and a rear end;

a line segment supported on the substrate that defines a 0 degree line extending co-axial to the longitudinal axis of the substrate and parallel to a longitudinal axis of the simulated arrow shaft;

a base line that is perpendicular to the 0 degree line and the longitudinal axis that intersects the 0 degree line at the origin point a predetermined distance from the rear end of the substrate;

a plurality of alignment lines spaced apart from each other in a plurality of predetermined angles in at least one left offset and right offset, or helical fletching directions that originate at the origin point; and indexing marks oriented around the rear end of the substrate.

15. The method of claim 14, further comprising the step of securing the substrate to the simulated arrow shaft via an adhesive.

* * * * *